US011041386B2

(12) United States Patent
Gossen

(10) Patent No.: US 11,041,386 B2
(45) Date of Patent: Jun. 22, 2021

(54) COMPRESSOR WITH A CARRIER ELEMENT FOR SUPPORT A COMPRESSOR BODY BASE

(71) Applicant: BITZER Kuehlmaschinenbau GmbH, Sindelfingen (DE)

(72) Inventor: Dimitri Gossen, Altdorf (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 283 days.

(21) Appl. No.: 16/108,771

(22) Filed: Aug. 22, 2018

(65) Prior Publication Data

US 2018/0363464 A1 Dec. 20, 2018

Related U.S. Application Data

(63) Continuation of application No. PCT/EP2016/053943, filed on Feb. 25, 2016.

(51) Int. Cl.
*F01C 1/02* (2006.01)
*F04C 18/02* (2006.01)
(Continued)

(52) U.S. Cl.
CPC ..... *F01C 17/063* (2013.01); *F04C 18/0215* (2013.01); *F04C 18/0253* (2013.01);
(Continued)

(58) Field of Classification Search
CPC .. F01C 17/063; F01C 17/066; F04C 18/0215; F04C 18/0253; F04C 23/008;
(Continued)

(56) References Cited

U.S. PATENT DOCUMENTS 5,407,335 A * 4/1995 Caillat ..... F01C 1/0215 418/151
5,468,130 A * 11/1995 Yamada ..... F01C 17/06 418/55.2
(Continued)

FOREIGN PATENT DOCUMENTS

EP 2012016 A1 1/2009
EP 2940247 A1 11/2015
(Continued)

*Primary Examiner* — Deming Wan
(74) *Attorney, Agent, or Firm* — Reinhart Boerner Van Deuren P.C.

(57) ABSTRACT

In order to optimise a compressor, including a compressor housing, a scroll compressor unit that is arranged in the compressor housing and has a first compressor body and a second compressor body that is movable in relation to the first compressor body, an axial guide that supports the movable compressor body to prevent movements in the direction parallel to the centre axis of the stationary compressor body and, in the event of movements, guides it in the direction transverse to the centre axis, parallel to a plane perpendicular to the centre axis, an eccentric drive for the scroll compressor unit, wherein the eccentric drive has an entrainer that is driven by the drive motor, that revolves on a path about the centre axis and that, for its part, cooperates rotatably with an entrainer receptacle in the second compressor body, and a coupling that prevents the second compressor body from rotating freely, it is proposed that the axial guide should have a carrier element, which serves as a base for supporting a compressor body base, which carries the scroll vane, of the second compressor body against an axial support face, that the axial support face should be arranged radially outward of the entrainer, and that the coupling that prevents free rotation should have at least two coupling element sets that, for their part, include at least two
(Continued)

coupling elements, and that the coupling element sets should be arranged radially outward of the axial support face.

39 Claims, 12 Drawing Sheets

(51) Int. Cl.
*F01C 17/06* (2006.01)
*F04C 23/00* (2006.01)
*F04C 29/00* (2006.01)
*F04C 27/00* (2006.01)

(52) U.S. Cl.
CPC ..... *F04C 23/008* (2013.01); *F04C 27/005* (2013.01); *F04C 29/0021* (2013.01); *F04C 2240/801* (2013.01)

(58) Field of Classification Search
CPC ..... F04C 29/0021; F04C 29/0057; F04C 29/085; F04C 2240/801
See application file for complete search history.

(56) References Cited

U.S. PATENT DOCUMENTS 5,575,635 A * 11/1996 Yamamoto ..... F04C 18/0215 418/55.5
10,634,141 B2 * 4/2020 Gossen ..... F04C 18/0253
2004/0191082 A1 * 9/2004 Gennami ..... F04C 29/028 417/310
2012/0308414 A1 * 12/2012 Ogawa ..... F04B 39/06 417/410.5
2014/0134033 A1 * 5/2014 Tozawa ..... F01C 17/06 418/55.3
2014/0369819 A1 * 12/2014 Yamashita ..... F04C 27/00 415/170.1
2015/0044082 A1 * 2/2015 Kiem ..... F04C 18/0215 418/55.2
2015/0086404 A1 * 3/2015 Kiem ..... F04C 18/07 418/55.1

FOREIGN PATENT DOCUMENTS

JP S5958188 A 4/1984
JP S6278494 A 4/1987

* cited by examiner

COMPRESSOR WITH A CARRIER ELEMENT FOR SUPPORT A COMPRESSOR BODY BASE

CROSS-REFERENCE TO RELATED PATENT APPLICATION

This application is a continuation of International application number PCT/EP2016/053943 filed on Feb. 25, 2016.

This patent application claims the benefit of International application No. PCT/EP2016/053943 of Feb. 25, 2016, the teachings and disclosure of which are hereby incorporated in their entirety by reference thereto.

BACKGROUND OF THE INVENTION

The invention relates to a compressor, including a compressor housing, a scroll compressor unit that is arranged in the compressor housing and has a first, stationary compressor body and a second compressor body that is movable in relation to the stationary compressor body, whereof first and second scroll vanes, in the shape of a circle involute, engage in one another to form compressor chambers when the second compressor body is moved in relation to the first compressor body on an orbital path running around a centre axis of the stationary compressor body, an axial guide that supports the movable compressor body to prevent movements in the direction parallel to the centre axis of the stationary compressor body and, in the event of movements, guides it in the direction transverse to the centre axis, parallel to a plane perpendicular to the centre axis, an eccentric drive for the scroll compressor unit, wherein the eccentric drive has an entrainer that is driven by the drive motor, that revolves on a path about the centre axis aft and that, for its part, cooperates rotatably with an entrainer receptacle in the second compressor body, and a coupling that prevents the second compressor body from rotating freely.

In such compressors, the problem arises of giving the axial guide for the movable compressor body the optimum construction.

The object of the invention is to optimise a compressor of the type described in the introduction.

SUMMARY OF THE INVENTION

According to the invention, this object is achieved in a compressor of the type described in the introduction in that the axial guide has a carrier element, which serves as a base for supporting a compressor body base, which carries the scroll vane, of the second compressor body against a support face, in that the support face is arranged radially outward of the entrainer, and in that the coupling that prevents free rotation has at least two coupling element sets that, for their part, include at least two coupling elements, and in that the coupling element sets are arranged radially outward of the axial support face.

The advantage of the solution according to the invention can be seen in the fact that, on the one hand, the coupling element sets are arranged at the greatest possible radial spacing from the centre axis and thus, as a result of the greater lever arm, the forces acting on the individual coupling elements are smaller, such that the individual coupling elements need only be constructed for smaller forces.

Furthermore, with this solution there is the advantage that as a result a space of optimum size is available for arranging and forming the axial support face.

Here, it is particularly favourable if the axial support face runs around the entrainer in order in this way to achieve optimum support of the second compressor body.

Because an entrainer receptacle is conventionally arranged in the second compressor body, it is preferably likewise provided for the axial support face to be arranged radially outward of the entrainer receptacle.

Here, the axial support face could run at a radial spacing from the entrainer receptacle.

A solution that is spatially particularly optimal provides for the axial support face to be arranged radially adjoining the entrainer receptacle and thus to extend radially outward from the entrainer receptacle.

As regards the relative arrangement of the axial support face and the entrainer receptacle, it is preferably provided for the axial support face to be arranged on a side of the entrainer receptacle that is remote from the scroll vane.

Here, the axial support face may take the most diverse forms.

An advantageous solution provides for the axial support face to include an annular face region running peripherally around a centre axis of the second compressor body, wherein an annular face region of this kind ensures optimum lubrication of the axial support face.

In this case, it is particularly advantageous if the annular face region takes the form of a face that runs continuously and in a closed manner around the centre axis in a peripheral direction—that is to say that the annular face region has no interruptions in the peripheral direction.

Further, it is advantageous if the annular face region extends from an internal contour to an external contour continuously and in a closed manner in the radial direction in relation to the centre axis of the second compressor body.

In particular, it is favourable if the annular face region is thus formed as an overall homogeneous region with no interruptions both in the peripheral direction and also in the radial direction, and with no singular points.

A favourable solution, which in particular forms a sufficiently large axial support face, provides for a radius of the internal contour of the annular face region to be less than two thirds of a radius of the external contour of the annular face region.

Further, overall it is provided for the annular face region of the axial support face to include at least 80% of the total surface area of the axial support face and in particular for the continuous and closed region of the axial face to be predominant in supporting the second compressor body.

In the simplest case, the axial support face of the second compressor body could be slidably supported on a stationary element.

However, it is particularly advantageous if the axial support face lies, slidably transversely to the centre axis, on a sliding body which for its part is supported, slidably transversely to the centre axis, on a carrier element that is arranged in the compressor housing. This provides the possibility of optimising support of the second compressor body using the sliding element.

The advantage of this solution can be seen in the fact that, as a result of the sliding body provided between the axial support face and of the compressor body base and the carrier element on the compressor housing, it is possible to guide the second compressor body on the one hand with optimum support and on the other with little wear, since the sliding body that is arranged between the axial support face and the carrier element creates the possibility of providing an optimum supply of lubricant.

In theory, the sliding body could be movable in one dimension, either in relation to the compressor body base or in relation to the carrier element.

It is particularly favourable if the sliding body is movable in two dimensions, in relation to the compressor body base and in relation to the carrier element.

This makes sufficient lubrication of the support between the axial support face and the sliding body, and between the sliding body and the carrier element, achievable simply and reliably.

Particularly advantageously, movability of the sliding body can be achieved if the sliding body is guided in a two-dimensional guidance with play such that it is movable in relation to the compressor body base and/or in relation to the carrier element.

Here, guidance with play allows the desired two-dimensional movability of the sliding body to be achieved in a simple manner and for the permitted extent thereof to be established.

For example, guidance with play makes it possible to establish that the sliding body can perform a limited orbital movement in relation to the compressor body base or in relation to the carrier element.

Here, the orbital movement is advantageously defined by a guiding orbital radius that is smaller than the compressor orbital radius of the movable compressor body. For example, the values of the guiding orbital radius for the sliding body are equal to 0.5 that of the compressor orbital radius or less. It is better if the values of the guiding orbital radius are 0.3 that of the compressor orbital radius or less, and, even better, 0.2 that of the compressor orbital radius or less.

In order to obtain a minimum lubrication, the guiding orbital radius is 0.01 that of the compressor orbital radius or more, and, better, 0.05 that of the compressor orbital radius or more.

More detailed comments have not yet been made as regards the form taken by the guidance with play.

Here, an advantageous solution provides for the guide to have a first guiding element that is arranged on the sliding body and a second guiding body element that is either connected to the compressor body base or to the carrier element.

The most diverse possibilities are conceivable for the form taken by the guiding elements.

It is particularly favourable if the guidance with play has, as the guiding elements, a guide pin and a guide recess that cooperates with the guide pin, and these are movable in two dimensions in relation to one another in that the guide pin engaging in the guide recess is movable within the guide recess as a result of its diameter, which is smaller than the diameter of the guide recess.

Here, the axial support face could be supported on individual face regions of the sliding body.

However, it is particularly favourable if the axial support face is supported on an annular face of the sliding body that runs peripherally around the centre axis of the first compressor body.

In particular, the annular face of the sliding body takes the form of an annular face that runs continuously and in a closed manner around the centre axis of the first compressor body in a peripheral direction.

Preferably in this case, the annular face of the sliding body is dimensioned such that it is larger than the annular face of the axial support face, with the result that the axial support face is always supported over its full surface on the annular face of the sliding body as the second compressor body orbits.

In order to ensure optimum provision of lubricant for a lubricant film between the axial support face and the sliding body, it is preferably provided for the axial support face to be adjoined, radially inwardly and/or radially outwardly, by an edge face that is set back in relation to a plane in which the axial support face extends.

A particularly favourable solution provides for the edge face to directly adjoin the axial support face and thus also to reach as far as the plane in which the axial support face extends, and then to run at an increasing spacing from the plane in which the axial support face extends as its spacing from the axial support face increases.

When the edge face has for example a step-shaped or wedge-shaped course of this kind, the supply of lubricant to the axial support face from the outside thereof is assisted.

The supply of lubricant between the axial support face and the sliding body may be further assisted if the axial support face and/or a sliding support face that carries the axial support face is provided with micro-recesses, for example recess structures that result from the material and/or are machined and/or stamped in, and that receive, retain and distribute lubricant.

More detailed comments have not yet been made as regards guidance of the sliding body in relation to the carrier element.

Here, an advantageous solution provides for the sliding body to be supported against the carrier element by a sliding bearing face.

The sliding bearing face could in this case also be formed by partial faces.

It is particularly favourable if the sliding bearing face takes the form of an annular face that runs continuously and in a closed manner around the centre axis of the stationary compressor body in the peripheral direction.

Furthermore, it is preferably provided for the carrier element to have a carrier face against which the sliding body is supported by the sliding bearing face.

This carrier face could also be formed by individual partial faces.

However, it is particularly advantageous if the carrier face takes the form of an annular face that runs continuously and in a closed manner around the centre axis of the stationary compressor body in the peripheral direction.

The supply of lubricant between the carrier element and the sliding body may be further assisted if the sliding bearing face and/or a carrier face that carries the sliding bearing face is provided with micro-recesses, for example recess structures that result from the material and/or are machined and/or stamped in, and that receive, retain and distribute lubricant.

Further, more detailed comments have not been made as regards the form taken by the sliding body.

In principle, the sliding body could take any desired shape.

For reasons of manufacturing engineering, it is particularly favourable if the sliding body takes a plate-like form, in particular as an annular disc.

More detailed comments have not yet been made as regards the form taken by the second compressor body.

Here, an advantageous solution provides for the second compressor body to be provided with extensions that extend radially outward of the centre axis thereof and on each of which a coupling element of the coupling element sets is held.

If the second compressor body is formed in this way, there is a possibility of giving it the smallest possible mass and, on the other hand, of arranging the coupling element sets at the greatest possible radial spacing from the centre axis.

In particular in this case, the extensions are held on a compressor body base of the second compressor body, such that it becomes possible to guide the second compressor body with the smallest possible tilting moments.

It is particularly favourable if the extensions are integrally formed in one piece with the compressor body base.

In this case, there is for example the possibility of making the second compressor body from an extruded profile and hence producing the basic shape, that is to say the shape of the compressor body base with the extensions integrally formed thereon, from this basic shape, wherein the scroll vanes are then formed by machining a portion of the extruded profile.

In order, with a solution of this kind, to keep the radial extent of the compressor housing as small as possible, that is to say to form the compressor housing to take up as little space as possible, it is preferably provided for the extensions to engage in intermediate spaces arranged around the second compressor body on the housing side.

A particularly advantageous solution provides for the first compressor body to be positioned in the direction of its centre axis by supporting fingers, and in particular at the same time to be supported in relation to the carrier element.

In general, this solution has the advantage that the carrier element is thus given the possibility of establishing on the one hand the axial position of the first compressor body, on the other the axial position of the second compressor body, and hence in particular the axial position of the two compressor bodies in relation to one another, such that as a result the carrier element represents the sole component from which the positions of the compressor elements are definable.

In the provision of supporting fingers, it is favourable if the intermediate spaces are arranged between the supporting fingers that carry the first compressor body.

Moreover, an advantageous solution provides for the first compressor body to be positioned by the supporting fingers such that it cannot rotate freely.

Further, it is advantageously provided for the first compressor body to be fixed by the supporting fingers such that it cannot rotate freely in relation to the carrier element, to prevent rotation about its centre axis.

This provides the possibility of using the carrier element to fix the first compressor body exactly as regards its position in the compressor housing, and moreover, using the carrier element, also to position the second orbital compressor body precisely as regards its position in relation to the first compressor body in the direction of the centre axis.

Further, more detailed comments have not been made as regards the choice of materials in the compressor according to the invention.

Here, an advantageous solution provides for the first, stationary compressor body to be made from a low-wear aluminium alloy.

A first compressor body of this kind has optimum stability and fatigue strength.

Further, it is preferably provided for the second compressor body to be made from a low-wear aluminium alloy, in particular from a cast aluminium alloy.

Manufacturing the second compressor body from an aluminium alloy has the advantage that this second compressor body has a small mass, which is advantageous in particular if the second compressor body is to move at high speed on the orbital path about the centre axis of the first compressor body.

Further, pairing the materials of an aluminium alloy and cast steel for the first and the second compressor body has the advantage of good running properties with high fatigue strength and long service life.

More detailed comments have not been made in conjunction with the description given above of the individual implementations as regards the material for the sliding body.

In principle, the sliding body could be made from any desired material, although there should be an optimum pairing of materials for the second compressor body and the carrier element.

Here, it has proved particularly advantageous if the sliding body is made from spring steel.

Forming the sliding body from spring steel has the advantage on the one hand that it provides a favourable pairing of materials with the second compressor body, made from aluminium, and on the other hand that it also allows an optimum pairing of materials with the carrier element.

Moreover, forming the sliding body from spring steel also has major advantages for cost reasons, since spring steel is an inexpensive material from which the shape suitable for the sliding body can be made in simple manner by cutting or punching.

More detailed comments have not yet been made as regards the carrier element.

In the simplest case, the carrier element could be made from steel or indeed from the material of the compressor housing.

In order to achieve a very sturdy construction, however, it is preferably provided for the carrier element to be made from an aluminium alloy, for example the same aluminium alloy as the compressor bodies.

A particularly favourable solution provides for the carrier element to have a carrier face having a surface texture on which the sliding body is supported by means of its sliding bearing face.

A surface texture for the carrier face that is for example provided has the major advantage that it can advantageously take up lubricant and then also discharge it for the purpose of lubrication between the carrier face and the sliding bearing face.

In this case, the lubricant may be held in particular in the surface texture such that a film of lubricant can be permanently maintained between the carrier face and the sliding bearing face in a simple manner.

The use of sintered material that is softer than the spring steel of the sliding element has proved favourable, such that a pairing of the materials of the carrier element and the sliding body that is advantageous for sliding guidance is produced.

In an advantageous solution, it is provided in particular for the axial support face to be formed by the compressor body base, which carries the scroll vane, of the second compressor body itself and for the axial guide to support the second compressor body against this axial support face, slidably transversely to the centre axis.

A solution of this kind may be produced in a manner that is particularly advantageous for production engineering, since there is no need for a separate part for forming the support face, but rather the support face may itself be formed by a compressor body base.

In particular, it is favourable if the entrainer receptacle is integrated in the compressor body base such that there is no need for a further part for this either.

Preferably in this case, the entrainer receptacle is arranged on the compressor body base such that it does not project beyond the support face in the direction parallel to the centre axis of the movable compressor body, with the result that the forces acting on the entrainer receptacle when the second compressor body is driven, as seen in the direction parallel to the centre axis, act on the second compressor body between the support face and the scroll vanes and hence the tilting moments that act on the second compressor body during operation of the scroll compressor unit are kept small.

The coupling that prevents free rotation may be achieved in the most diverse ways.

In order to improve guidance of the second compressor body in relation to the compressor housing by the coupling, it is preferably provided for the coupling that prevents free rotation to have more than two coupling element sets.

More detailed comments have not yet been made as regards the coupling element sets.

Here, an advantageous solution provides for the coupling element sets to be arranged at equal angular spacings around the centre axis of the orbital path.

In order to achieve advantageous support of the second compressor body in relation to the compressor housing using a coupling of this kind, it is preferably provided for one of the coupling elements to be held on the compressor body base.

Further, it is preferably provided for one of the coupling elements to be held on the carrier element.

In this case, the coupling element sets are thus arranged and take a form such that they are active directly between the carrier element and the compressor body base of the second compressor body, with the result that a compact construction can be achieved.

More detailed comments have not yet been made as regards the form taken by the coupling elements themselves.

Here, an advantageous solution provides for one of the coupling elements of the respective coupling element set to be formed by a pin body.

Moreover, it is advantageously provided for one of the coupling elements of the respective coupling element set to take the form of a cylindrical receptacle.

A further advantageous solution provides for one of the coupling elements of the respective coupling element set to take the form of an annular body arranged in the cylindrical receptacle.

Preferably, it is provided here for the annular body to be seated in the cylindrical receptacle loosely, that is to say with play, and thus to be able to move in relation to the cylindrical receptacle.

A construction of this kind of the coupling element sets has the major advantage on the one hand that they ensure optimum lubrication and on the other that they enable low-noise movement of the second compressor body in relation to the first compressor body, since in each of the coupling element sets there are two films of lubricant with a damping action, namely on the one hand a film of lubricant between the pin body and the annular body and on the other a film of lubricant between the annular body and the cylindrical receptacle in which the annular body is arranged.

More detailed comments have not yet been made as regards the arrangement of the coupling element sets in relation to the sliding body.

It is particularly favourable if the sliding body and the coupling element sets are arranged separately from one another.

In particular, it is provided for the coupling element sets to be arranged outwardly around the sliding body.

The features of the solution according to the invention that have been described in conjunction with the configurations above are particularly advantageous if the centre axis of the stationary compressor body extends level and/or upright.

Here, a level extent of the centre axis of the stationary compressor body means that during operation of the compressor according to the invention the centre axis extends approximately parallel to the horizontal, wherein the term "approximately parallel" should be understood to mean that the angle between the centre axis and the horizontal when the compressor according to the invention is used in a normal operating mode is at most 30°, or better at most 20°.

Further, in the solution according to the invention it is likewise advantageously provided for the drive shaft of the drive motor to extend substantially level, wherein the same conditions apply to the angle between the centre axis of the drive shaft and the horizontal as for the alignment of the centre axis of the stationary compressor body in relation to the horizontal.

Moreover, it is advantageous for the object stated in the introduction if the compressor housing is also made from an aluminium alloy, so that the compressor according to the invention can be constructed with as low a weight as possible, for example from an extruded profile.

Moreover, this also gives the compressor better resistance to the influence of external weather conditions.

Further features and advantages of the invention form the subject matter of the description below and the representation in the drawing of some exemplary embodiments.

DETAILED DESCRIPTION OF THE INVENTION

Figure 1:
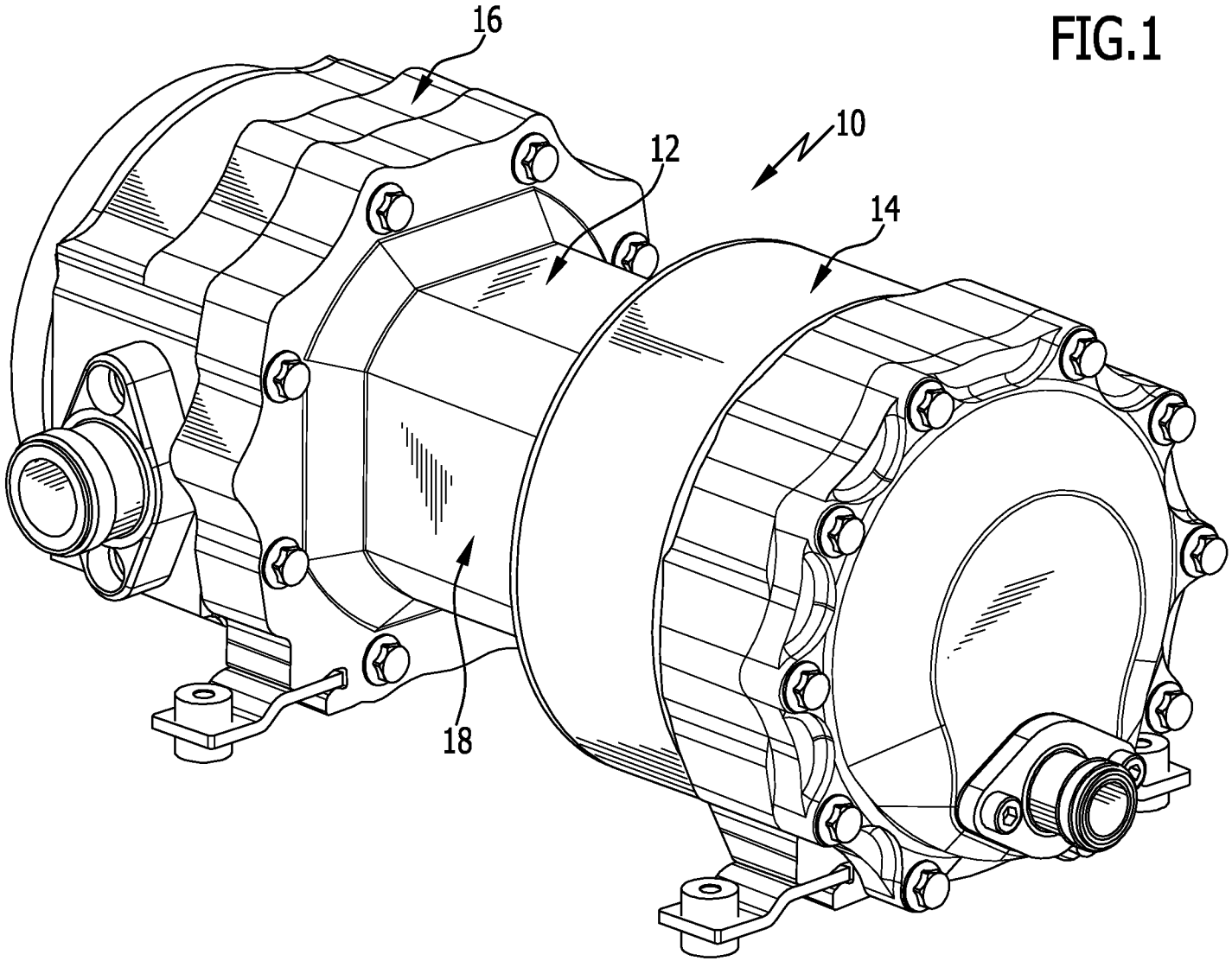
FIG. 1 shows a perspective illustration of a first exemplary embodiment of a compressor according to the invention.

A first exemplary embodiment illustrated in FIG. 1, of a compressor according to the invention which is designated 10 as a whole, and is for a gaseous medium, in particular a refrigerant, includes a compressor housing which is designated 12 as a whole and has a first end housing portion 14, a second end housing portion 16 and an intermediate portion 18 arranged between the end housing portions 14 and 16.

As illustrated in FIG. 2 to FIG. 8, provided in the first housing portion 14 is a scroll compressor unit which is designated 22 as a whole and has a first compressor body 24, which is arranged to be stationary in the compressor housing 12, in particular in the first housing portion 14, and a second compressor body 26, which is movable in relation to the stationary compressor body 24.

The first compressor body 24 includes a compressor body base 32 from which a first scroll vane 34 projects, and the second compressor body 26 likewise includes a compressor body base 36 from which a second scroll vane 38 projects.

Figure 4:
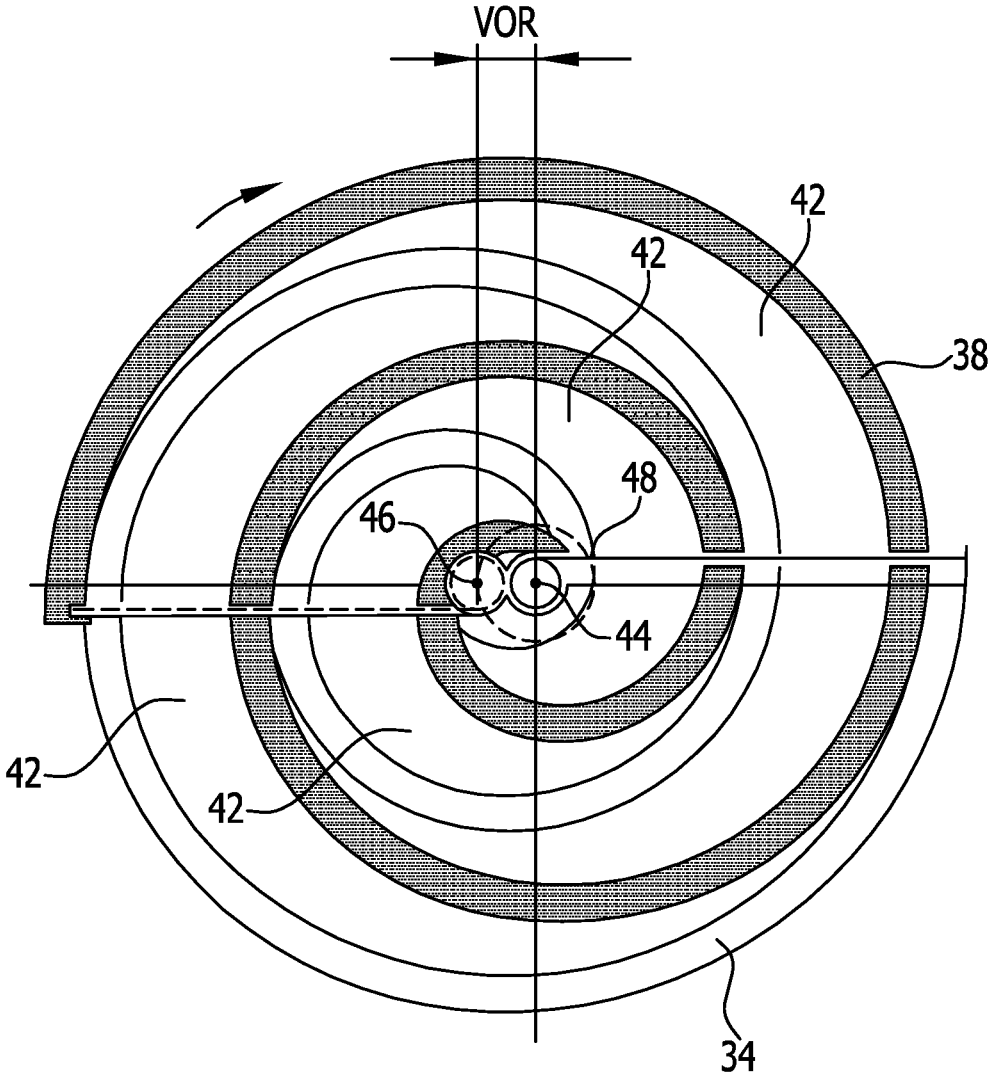
FIG. 4 shows a schematic illustration of mutually engaging scroll vanes and of the orbital path of one of the scroll vanes, and an illustration of an orbital path of the movable scroll vane in relation to the stationary scroll vane.
Figure 5:
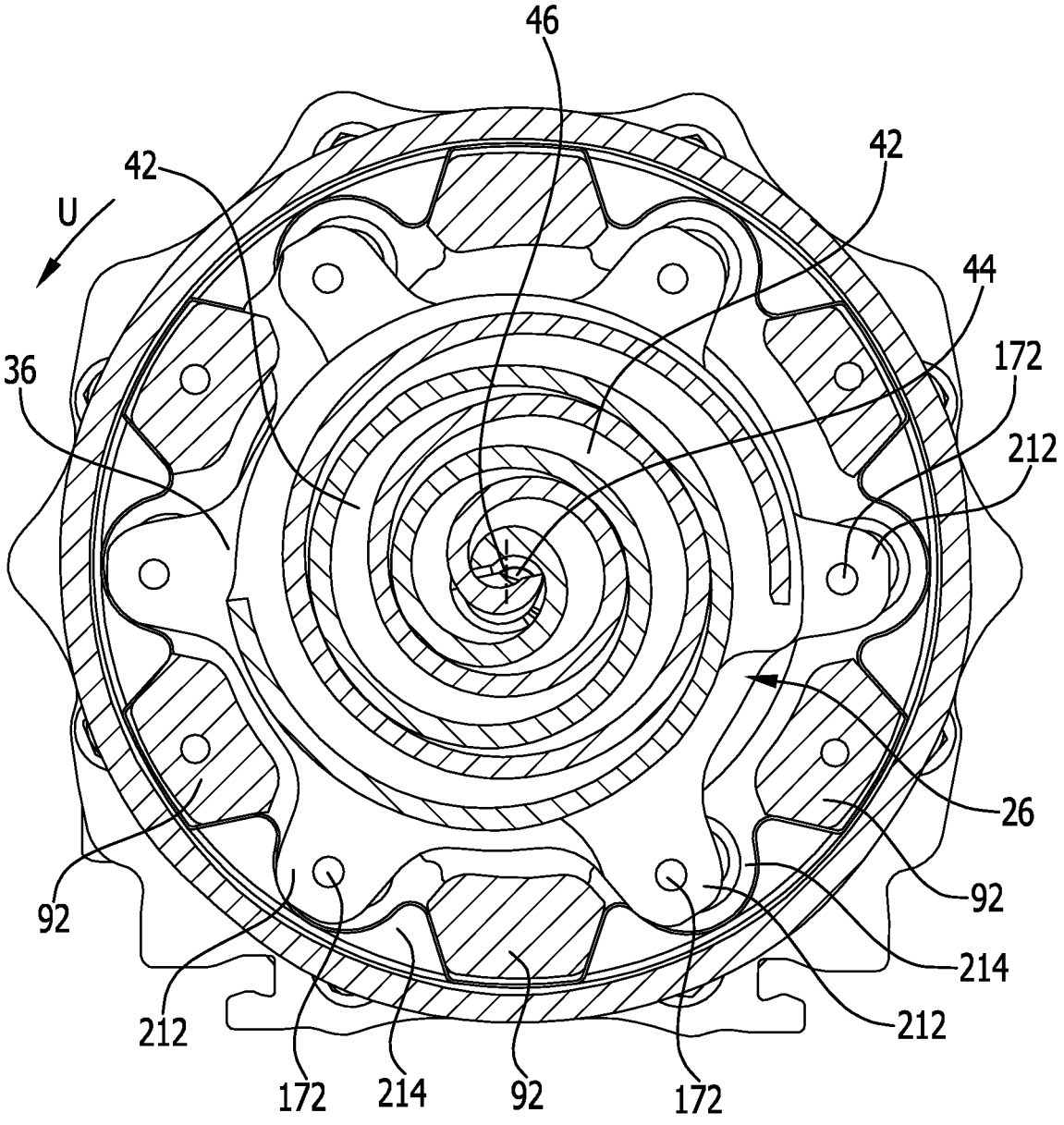
FIG. 5 shows a cross section through a scroll compressor unit, along the line 5-5 in FIG. 3, in the region of the mutually engaging scroll vanes.

The compressor bodies 24 and 26 are arranged in relation to one another such that the scroll vanes 34, 38 engage in one another in order to form between them, as illustrated in FIG. 4, at least one and preferably a plurality of compressor chambers 42 in which the gaseous medium, for example refrigerant, is compressed in that the second compressor body 26 moves with its centre axis 46 about a centre axis 44 of the first compressor body 24 on an orbital path 48 having a compressor orbital path radius VOR, wherein the volume of the compressor chambers 42 decreases and ultimately compressed gaseous medium emerges through a central outlet 52, while gaseous medium to be drawn in is drawn in on the radially outer side in relation to the centre axis 44, through peripherally opening compressor chambers 42.

The compressor chambers 42 are also sealed off from one another in particular in that the scroll vanes 34, 38 are provided on their end side with axial sealing elements 54 and 58 respectively, which abut sealingly against the respective bottom face 62, 64 of the respectively other compressor body 26, 24, wherein the bottom faces 62, 64 are formed by the respective compressor body base 36 and 32 respectively and lie in a plane extending perpendicular to the centre axis 44.

The scroll compressor unit 22 is received as a whole in a first housing body 72 of the compressor housing 12, wherein this housing body 72 has an end-side cover portion 74 and a cylindrical annular portion 76 that is integrally formed in one piece with the end-side cover portion 74 and for its part engages by means of an annular projection 78 in a sleeve element 82 of the housing body 72, which is integrally formed on a central housing body 84 that forms the intermediate portion 18, wherein the central housing body 84 is terminated at a side opposite the first housing body 72 by a second housing body 86 that forms an inlet chamber 88 for the gaseous medium.

Here, the sleeve element 82 surrounds the scroll compressor unit 22, whereof the first compressor body 24 is supported, by supporting fingers 92 that are integrally formed on the compressor body base 32, against a bearing face 94 in the housing body 72.

In particular, the first compressor body 24 is immovably fixed in the housing body 72 in a manner preventing any movement parallel to the bearing face 94.

In this way, the first compressor body 24 is fixed within the first housing body 72 and thus also within the compressor housing 12 such that it is stationary in a precisely defined position.

Figure 2:
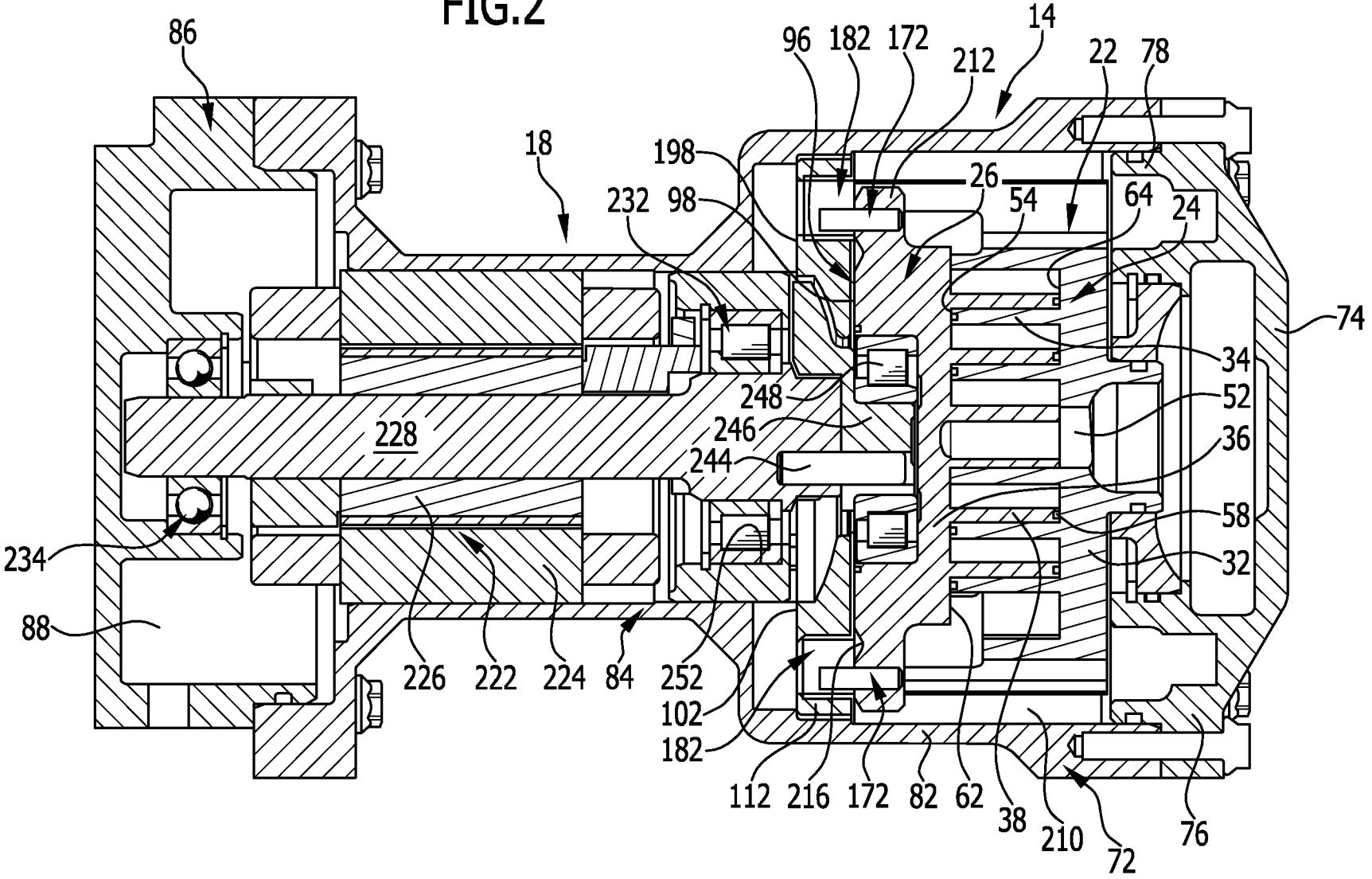
FIG. 2 shows a longitudinal section through the first exemplary embodiment of the compressor according to the invention, in a horizontal plane of section extending through a centre axis of a stationary compressor body.
Figure 3:
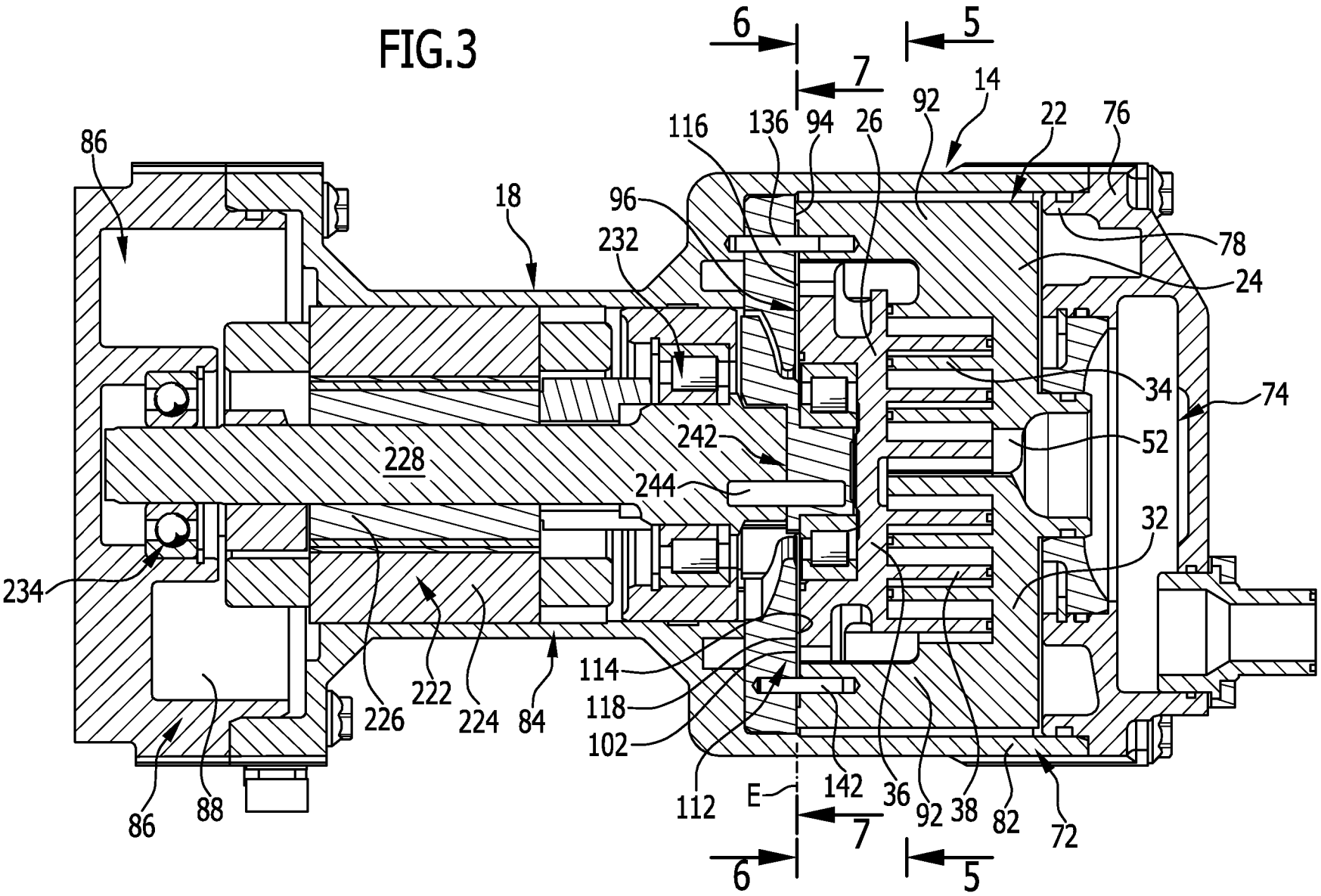
FIG. 3 shows a longitudinal section through the first exemplary embodiment of the compressor, similar to FIG. 2, in a vertical plane of section extending through the centre axis of the stationary compressor body.
Figure 6:
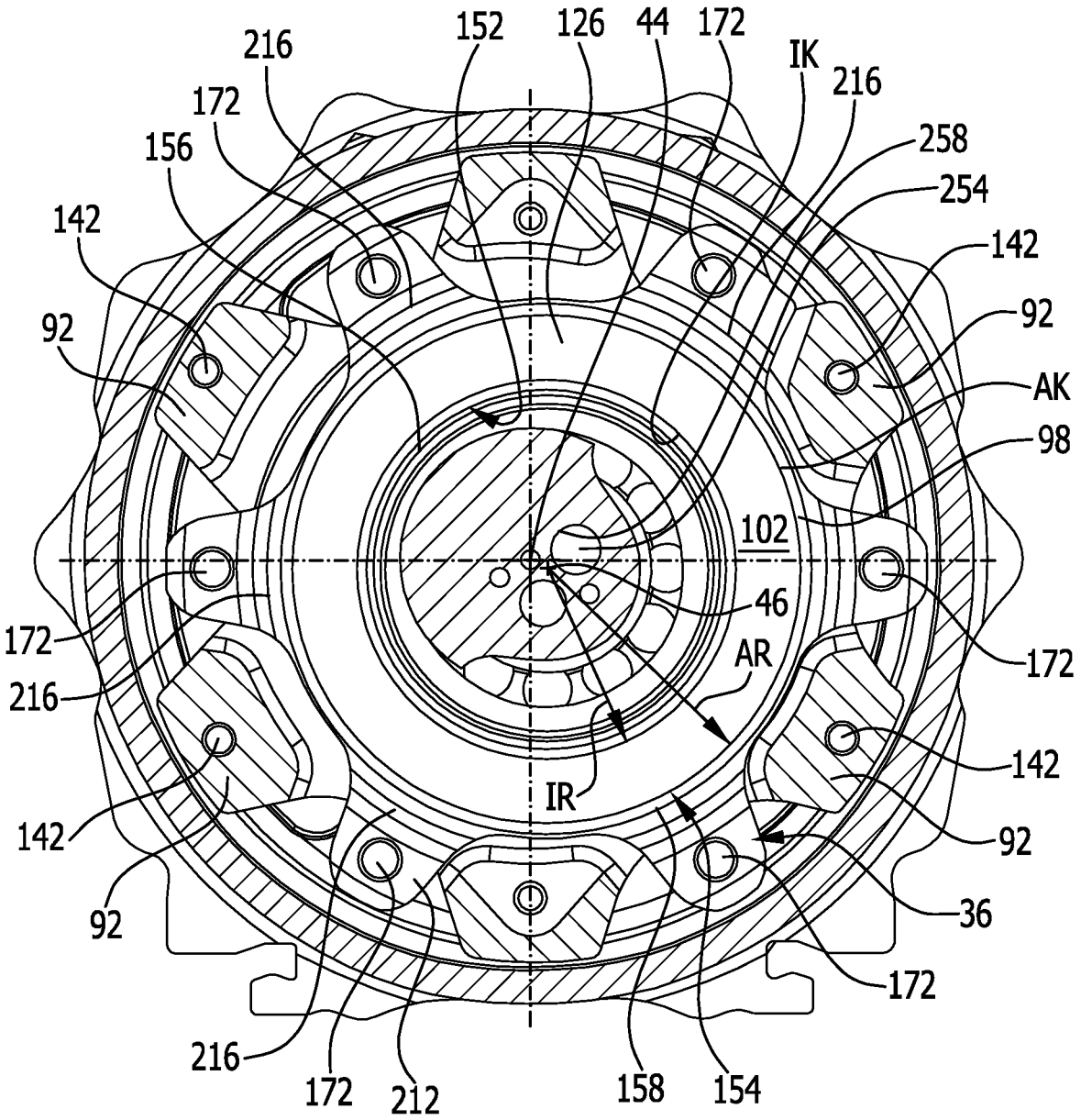
FIG. 6 shows a section along the line 6-6 in FIG. 3.

The second, movable compressor body 26, which has to move on the orbital path 48 about the centre axis 44 in relation to the first compressor body 24, is guided in relation to the centre axis 44 in the axial direction by an axial guide, which is designated 96 as a whole and supports and guides the compressor body base 36 at an underside 98 remote from the scroll vane 38, in the region of an axial support face 102, such that the compressor body base 36 of the second compressor body 26 is supported, in relation to the first compressor body 24 that is positioned stationary in the compressor housing 12, and in the direction parallel to the centre axis 44, such that the axial sealing elements 58 remain against the bottom face 64 and do not lift away therefrom, wherein at the same time the compressor body base 36 can move with the axial support face 102, slidably transversely to the centre axis 44 in relation to the axial guide 96 (FIGS. 2, 3 and 6).

Figure 7:
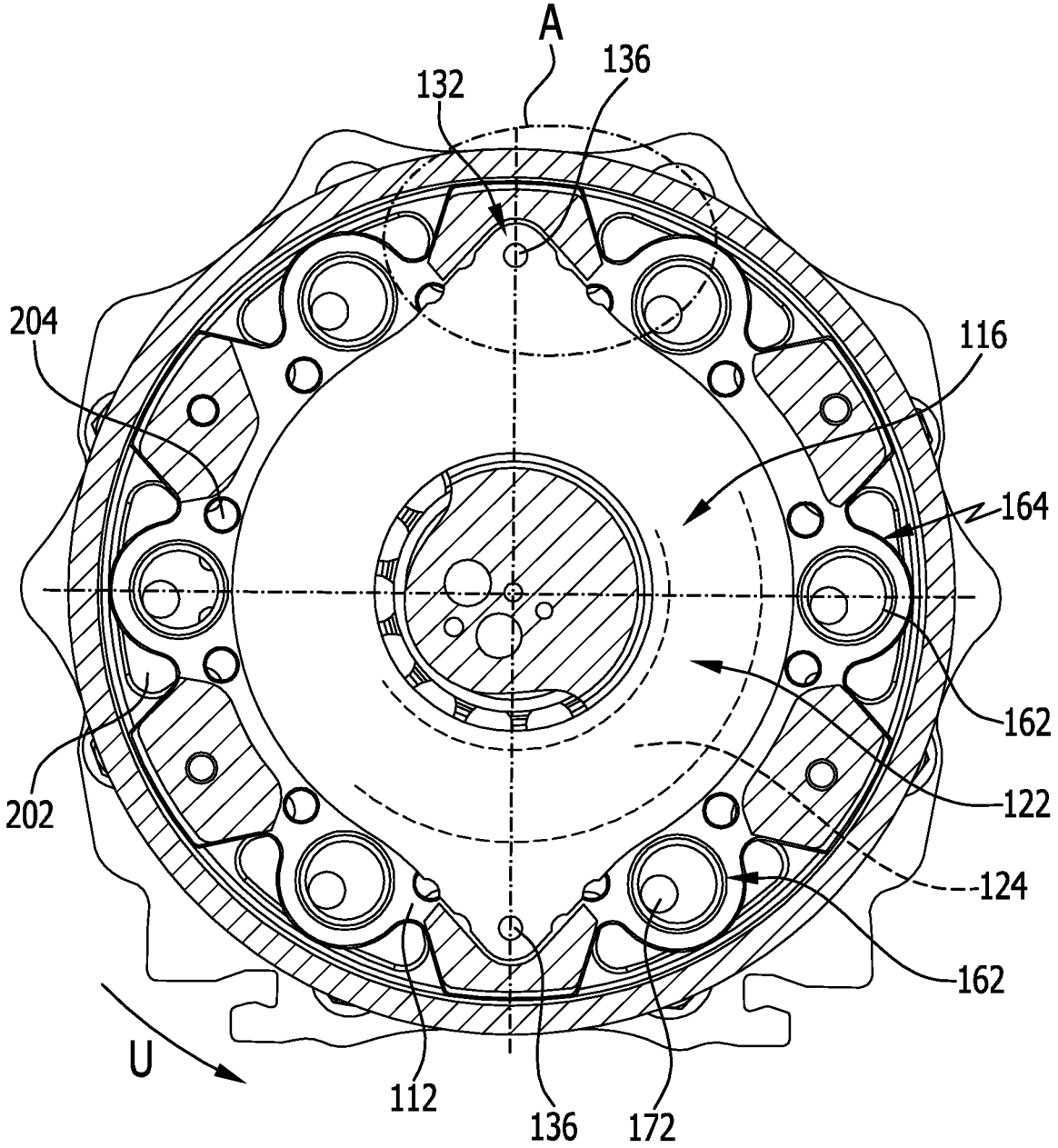
FIG. 7 shows a section along the line 7-7 in FIG. 3.

For this purpose, as illustrated in FIGS. 2, 3 and 7, the axial guide 96 is formed by a carrier element 112, which is made in particular from an open-pored sintered material and has a carrier face 114 that faces the axial support face 102 but on which the compressor body base 36 does not lie by means of the axial support face 102, but rather on which there lies a sliding body 116, in particular in the form of a plate and designated 116 as a whole, having a sliding bearing face 118, wherein the sliding body 116 guides the axial support face 102 in a manner supported by means of a sliding support face 122 opposing the sliding bearing face 118, to prevent movements parallel to the centre axis 44, but supported such that it can slide in respect of movements transverse to the centre axis 44.

In this way, an axial movement of the second compressor body 26 in the direction of the centre axis 44 is prevented, but a movement in a plane transverse, in particular perpendicular, to the centre axis 44 is made possible.

Here, the axial guide 96 according to the present invention provides, in the event of a movement of the second compressor body 26 on the orbital path 48 about the centre axis 44 of the first compressor body 24, on the one hand for the second compressor body 26 to move with the compressor body base 36 and the axial support face 102 thereof in relation to the sliding body 116, and on the other hand for the sliding body 116 itself to move in relation to the carrier element 118.

In this way, sliding takes place between the compressor body base 36 and the sliding body 116 as a result of a movement of the axial support face 102 in relation to the sliding support face 122 of the sliding body 116, and moreover the sliding bearing face 118 of the sliding body 116 slides in relation to the carrier face 114 of the carrier element 112.

To improve lubrication, for example the sliding support face 122 and the sliding bearing face 118 of the sliding body 116 are provided with recesses 123, in particular micro-recesses, which form receptacles for a lubricant and contribute to distribution of the lubricant.

Figure 8:
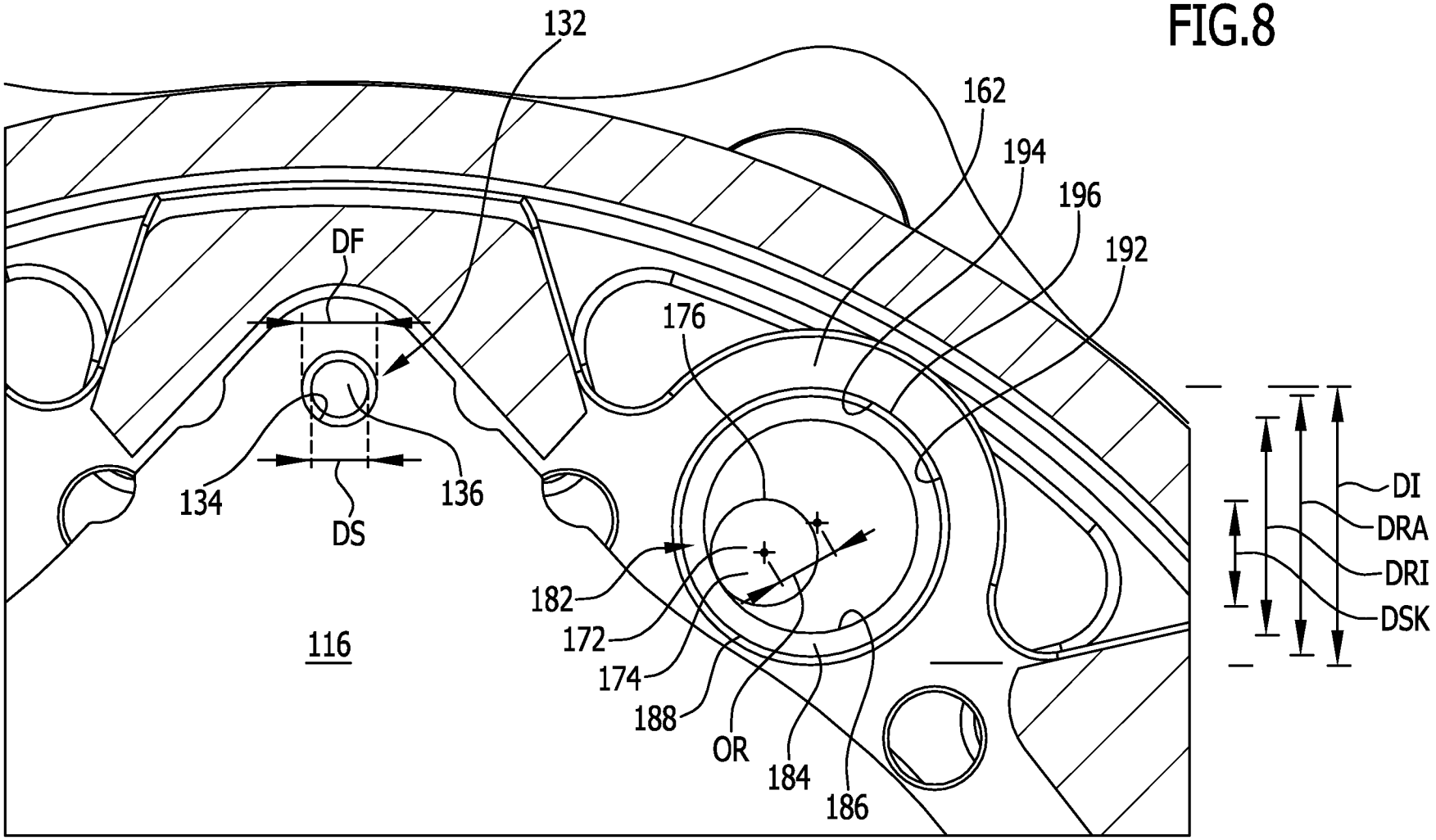
FIG. 8 shows an illustration, on a larger scale, of the region A in FIG. 7.

In order to predetermine the limited two-dimensional movability of the sliding body 116 in relation to the carrier element 112 and parallel to a plane E perpendicular to the centre axis 44, the sliding body 116 is guided in relation to the carrier element 112 by a guidance with play which is illustrated in FIGS. 7 and 8 and designated 132 as a whole, wherein the guidance with play 132 includes a guide cutout 134 that is provided in the sliding body 116 and has a diameter DF, and also includes a guide pin 136 that is anchored in the carrier element 112 and whereof the diameter DS is smaller than the diameter DF, with the result that half of the difference DF-DS defines a guide orbital radius by means of which the sliding body 116 can perform an orbital movement in relation to the carrier element 112.

As a result of the movements of the sliding body 116, a sufficient film of lubricant is formed between the axial support face 102 of the compressor body base 36 and the sliding support face 122 of the sliding body 116, and between the carrier face 114 and the sliding bearing face 118.

For a stable film of lubricant, it is sufficient if the guide orbital radius FOR is 0.01 times the compressor orbital radius or more, in particular 0.05 times the compressor orbital radius or more.

Further, for example, as a result of the fact that the carrier element 112 is made, at least in the region of the carrier face 114, from an aluminium alloy, in addition improved lubrication is ensured in that lubricant enters the surface texture of the carrier element 112 that is for example provided and is thus retained in the region of the carrier face 114 for the purpose of forming the film of lubricant in the intermediate space, by way of the pores of the carrier element 112.

The formation of the film of lubricant is additionally assisted by the fact that the sliding body 116 itself takes the form of an annular part in the form of a plate and made of spring steel, and so the sliding bearing face 118 facing the carrier face 114 creates a smooth surface of spring steel.

Further, the pairing of materials made from aluminium alloy, which is softer in the region of the carrier face 114 than spring steel, and the spring steel in the region of the sliding bearing face 118 has advantageous properties when used over the long term, because of the resistance to wear.

In the solution according to the invention, the carrier element 112 is provided not only with the carrier face 114 on which the sliding body 116 lies, but also with the bearing faces 94 against which the supporting fingers 92 of the first compressor body 24 are supported.

This provides the possibility of fixing the position of the first compressor body 24 and the position of the second compressor body 26 in relation to one another, in the direction of the centre axis 44, by giving the carrier element 112 a suitable form, wherein this is achieved in particular by a single face of the carrier element 112 including both the carrier face 114 and the bearing faces 94.

Further (as illustrated in FIGS. 3 and 5 to 10), the supporting fingers 92 are fixed such that they cannot rotate freely in relation to the carrier element 112 by both the carrier element 112 and also the positioning pins 142 that pass through the supporting fingers 92.

Further, the carrier element 112 is arranged to be seated fixedly in the housing body 72 both axially, in the direction of the centre axis 44, and also in a manner preventing rotary movements about the centre axis 44.

In order furthermore to ensure that a film of lubricant is formed between the sliding support face 122 and the axial support face 102, the compressor body base 36 is provided, in a radially inward edge region 152 and in a radially outward edge region 154, with an edge surface 156 and 158 respectively that extends at an inclination to the axial support face 102, is set back in relation to the axial support face 102 and, together with the sliding support face 122, results in an intermediate space that opens radially outwardly or radially inwardly in the shape of a wedge and facilitates the access of lubricant.

Further, the formation of the film of lubricant between the sliding support face 122 and the axial support face 102 is assisted by the fact that the sliding support face 122 and the axial support face 102 take the form, in the overlap region in which they cooperate, of annular faces 124 and 126 respectively that are continuous—that is to say they are not interrupted in the peripheral direction U about the centre axis and in their entire radial extent—wherein in particular the annular face 126 of the axial support face 102 extends from an internal contour IK of radius IR outward to an external contour AK, wherein the radius IR is less than two thirds of an outer radius AR.

Further, the annular face 124 of the sliding support face 122 is dimensioned such that the annular face 126 of the axial support face 102 always lies on the sliding support face 122 with contact over its full surface, in all relative movements thereto.

As illustrated in FIGS. 2 to 7, the axial support face 102 and the sliding support face 122 cooperating therewith and the carrier face 114 and the sliding bearing face 118 cooperating therewith all lie radially inwardly of a coupling 164 that has a plurality of coupling element sets 162, which are arranged at the same radial spacings from the centre axis 44 and at the same angular spacings in the peripheral direction U around the centre axis 44, and together form a coupling 164 that prevents the second, movable compressor body 26 from rotating freely.

Each of these coupling element sets 162 includes, as illustrated in FIGS. 2, 7 and 8, as the first coupling element 172 a pin body 174, which has a cylindrical face 176 and, by means of this cylindrical face 176, engages in a second coupling element 182.

The second coupling element 182 is formed by an annular body 184 that has a cylindrical internal face 186 and a cylindrical external face 188, which are arranged coaxially to one another.

This second coupling element 182 is guided in a third coupling element 192, which takes the form of a receptacle 194, provided in the carrier element 112, for the annular body 184 and has a cylindrical internal wall surface 196.

Here, in particular a diameter DI of the internal wall surface 196 is greater than a diameter DRA of the cylindrical external face 188 of the annular body 184, and a diameter DRI of the cylindrical internal face 186 is necessarily smaller than the diameter DRA of the cylindrical external face 188 of the annular body 184, wherein moreover the diameter DRI of the cylindrical internal face 186 is greater than a diameter DSK of the cylindrical face 176 of the pin body 174.

In this way, each coupling element set 162 forms a separate orbital guide, whereof the maximum orbital radius OR for the orbital movement corresponds to DI/2−(DRA−DRI)/2−DSK/2.

By dimensioning the orbital radius OR of the coupling element sets 162 such that it is slightly greater than the compressor orbital path radius VOR, defined by the compressor bodies 24 and 26 of the scroll compressor unit 22, the movable compressor body 26 is guided in relation to the stationary compressor body 24 by the coupling 164 such that in each case one of the coupling element sets 162 is active in order to prevent free rotation of the second, movable compressor body 26, wherein, for example if there are six coupling element sets 162, after an angular range of 60° has been covered, the action of each coupling element set 162 changes from one coupling element set 162 to the succeeding coupling element set 162, as seen in the direction of rotation.

Because each coupling element set 162 has three coupling elements 172, 182 and 192, and in particular an annular body 184 is active between the respective pin body 174 and the respective receptacle 194, on the one hand the resistance to wear of the coupling element sets 162 is improved and on the other the lubrication in the region thereof is improved, and moreover the development of noise in the coupling element sets 162, produced by the change in action from one coupling element set 162 to the next coupling element set 162, is also reduced.

Here, it is in particular essential that the coupling element sets 162 are given sufficient lubrication, in particular lubrication between the cylindrical face 176 of the pin body 174 and the cylindrical internal face 186 of the annular body 184, and lubrication between the cylindrical external face 188 of the annular body 184 and the cylindrical internal wall surface 196 of the receptacle 194.

For optimum lubrication of the coupling element sets 162, the receptacles 194 in the carrier element 112 are axially open on both sides, wherein the annular bodies 184 are held, on their sides remote from the second compressor body 26, by a radially inwardly projecting abutment element 198.

Moreover, further passage openings 202, 204, which allow lubricant and drawn-in refrigerant to pass through, are also provided in the carrier element 112.

For the purpose of receiving the coupling elements 172 that take the form of pin bodies 174, the compressor body base 36 is provided with star-shaped, radially outwardly directed extensions 212 that engage in intermediate spaces 214 between supporting fingers 92 that succeed one another in a peripheral direction U about the centre axis 44, with the result that the coupling elements 172 likewise lie in these intermediate spaces 214 and hence are arranged within the housing body 72 at the greatest possible radial spacing from the centre axis 44.

This positioning of the coupling element sets 162, predetermined by the greatest possible radial spacing of the coupling elements 172, at a likewise greatest possible radial spacing from the centre axis 44 has the advantage that, because of the large lever arm, the forces acting on the coupling element sets 162 can be kept as small as possible, which has an advantageous effect on the dimensioning of components.

A refrigerant flow and/or lubricant flow through the receptacles 194 is further simplified in that the extensions 212 have a recess 216 between the coupling elements 172 and the axial support face 102.

The inventive concept of lubrication of the axial guide 96 and the coupling element sets 162 is particularly advantageous if in the normal case the centre axes 44 and 46 of the compressor bodies 24 and 26 extend level, that is to say at an angle of at most 30° to the horizontal, in which case there is formed in the compressor housing 12, in particular in the region of the first housing body 72, at the lowest point with respect to the direction of gravity, a bath 210 of lubricant out of which lubricant swirls up during operation and in so doing is received and distributed in the manner described.

The movable compressor body 24 is driven (as illustrated in FIGS. 2 and 3) by a drive motor, in particular an electric motor, which is designated 222 as a whole and which has in particular a stator 224 that is held in the central housing body 84 and a rotor 226 that is arranged within the stator 224 and is arranged on a drive shaft 228 that extends coaxially in relation to the centre axis 44 of the stationary compressor body 24.

The drive shaft 228 is mounted on the one hand in a compressor-facing bearing unit 232 that is arranged between the drive motor 222 and the scroll compressor unit 22 and in the central housing body 84, and on the other in a bearing unit 234 remote from the compressor, which is arranged on an opposite side of the drive motor 222 to the bearing unit 232.

Here, the bearing unit 234 remote from the compressor is mounted for example in the second housing body 86, which closes off the central housing body 84 on an opposite side to the first housing body 72.

Medium that is drawn in here, in particular the refrigerant, flows from the inlet chamber 88 formed by the second housing body 86 and through the electric motor 222 in the direction of the compressor-facing bearing unit 232, flows around this and then flows in the direction of the scroll compressor unit 22.

By way of an eccentric drive which is designated 242 as a whole, the drive shaft 228 drives the movable compressor body 26, which moves in an orbit around the centre axis 44 of the stationary compressor body 24.

The eccentric drive 242 in particular includes an eccentric drive pin 244 that is held in the drive shaft 228 and moves an entrainer 246 on an orbital path around the centre axis 44, the entrainer 246 being mounted rotatably on the eccentric pin 244 and itself being mounted rotatably in a pivot bearing 248, wherein the pivot bearing 248 allows the entrainer 246 to rotate in relation to the movable compressor body 26.

The entrainer 246 is rotatable in relation to the eccentric pin 244 and in relation to an entrainer receptacle 252 to a limited extent, and enables the radius of the orbital movement of the movable compressor body 26 to be adapted so that the scroll vanes 34 and 38 are kept in abutment against one another.

For receiving the pivot bearing 248, as illustrated in FIGS. 2 and 3, the second compressor body 26 is provided with the entrainer receptacle 252 that receives the pivot bearing 248.

The entrainer receptacle 252 is in this case set back in relation to the flat side 98 of the compressor body base 36 and is thus arranged in a manner integrated within the compressor body base 36, with the result that the drive forces acting on the movable compressor body 26 are active on a side of the flat side 98 of the compressor body base 36 facing the scroll vane 38 and thus drive the movable compressor body 26 with a small tilting moment, the movable compressor body 26 being supported axially against the axial support face 102 by the axial guide 96, between the entrainer receptacle 252 and the drive motor 222 as seen in the direction of the centre axis 44, and guided movably in a direction transverse to the centre axis 44.

It is thus possible to give the carrier face 114 of the carrier element 112 a form such that it runs as far as possible in the direction of the drive shaft 228, with the result that the compressor body 26 can be favourably supported with as large a surface area as possible for the axial support face 102.

In the solution according to the invention, as illustrated in FIGS. 2, 3 and 6, the entrainer receptacle 252 is surrounded by the axial support face 102, which lies radially outward of the centre axis 46, and the axial support face 102 is for its part surrounded by the coupling element sets 162, which lie radially outward of the centre axis 44, of the coupling 164 that prevents free rotation of the second compressor body 26.

Figure 9:
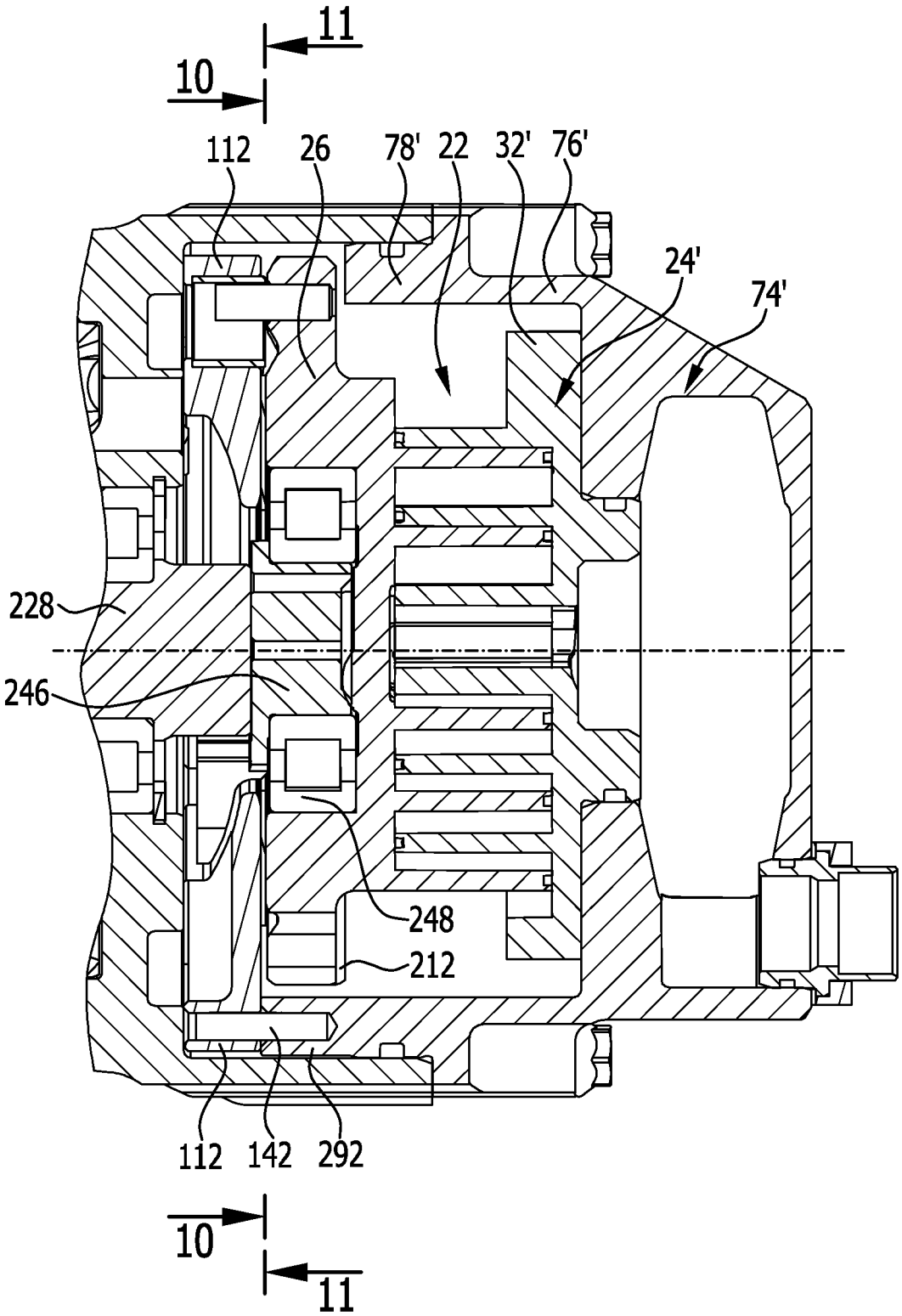
FIG. 9 shows a partial section, according to FIG. 3, through the compressor housing in the region of the scroll compressor unit, in a second exemplary embodiment.
Figure 10:
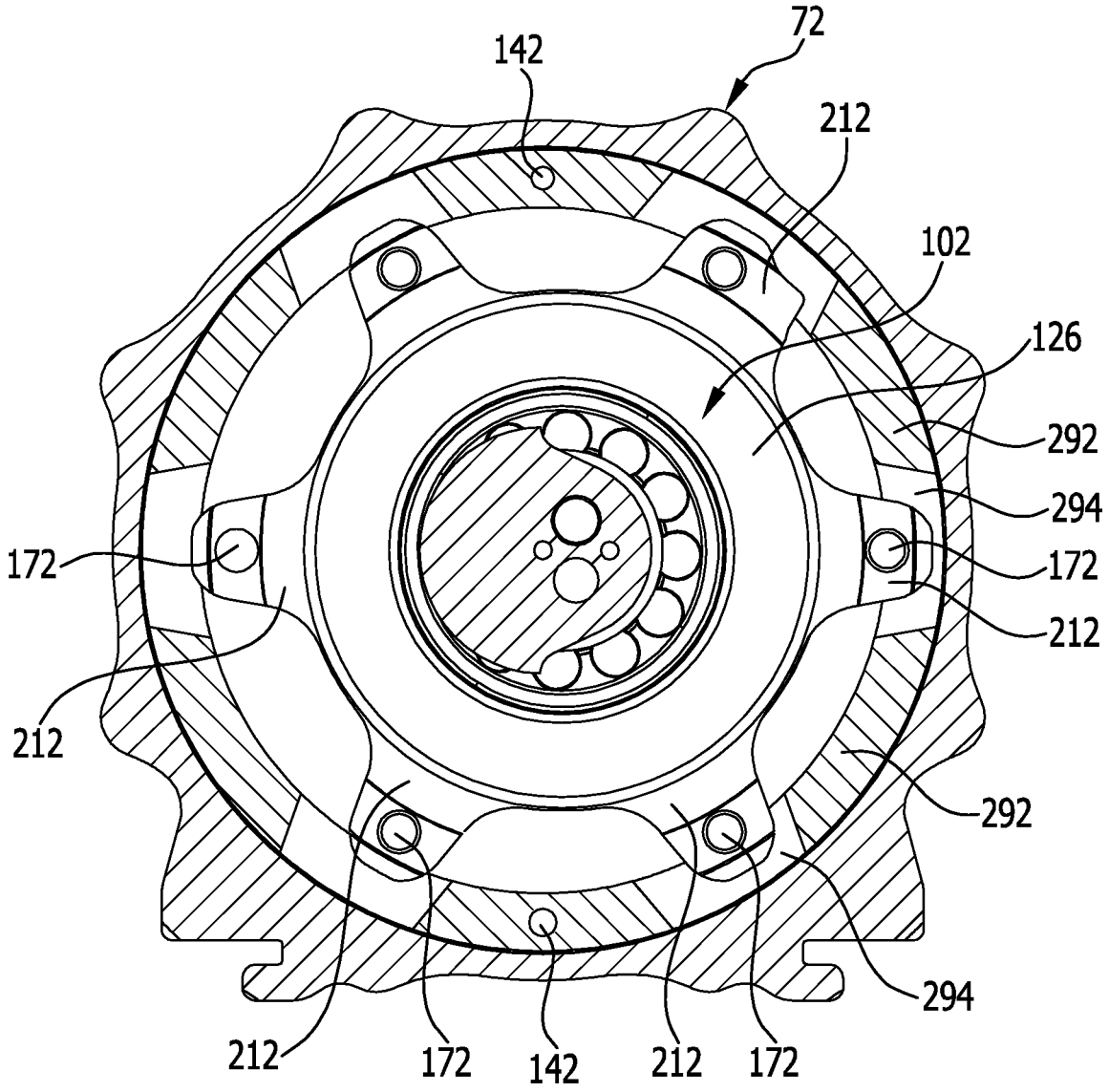
FIG. 10 shows a section along the line 10-10 in FIG. 9.
Figure 11:
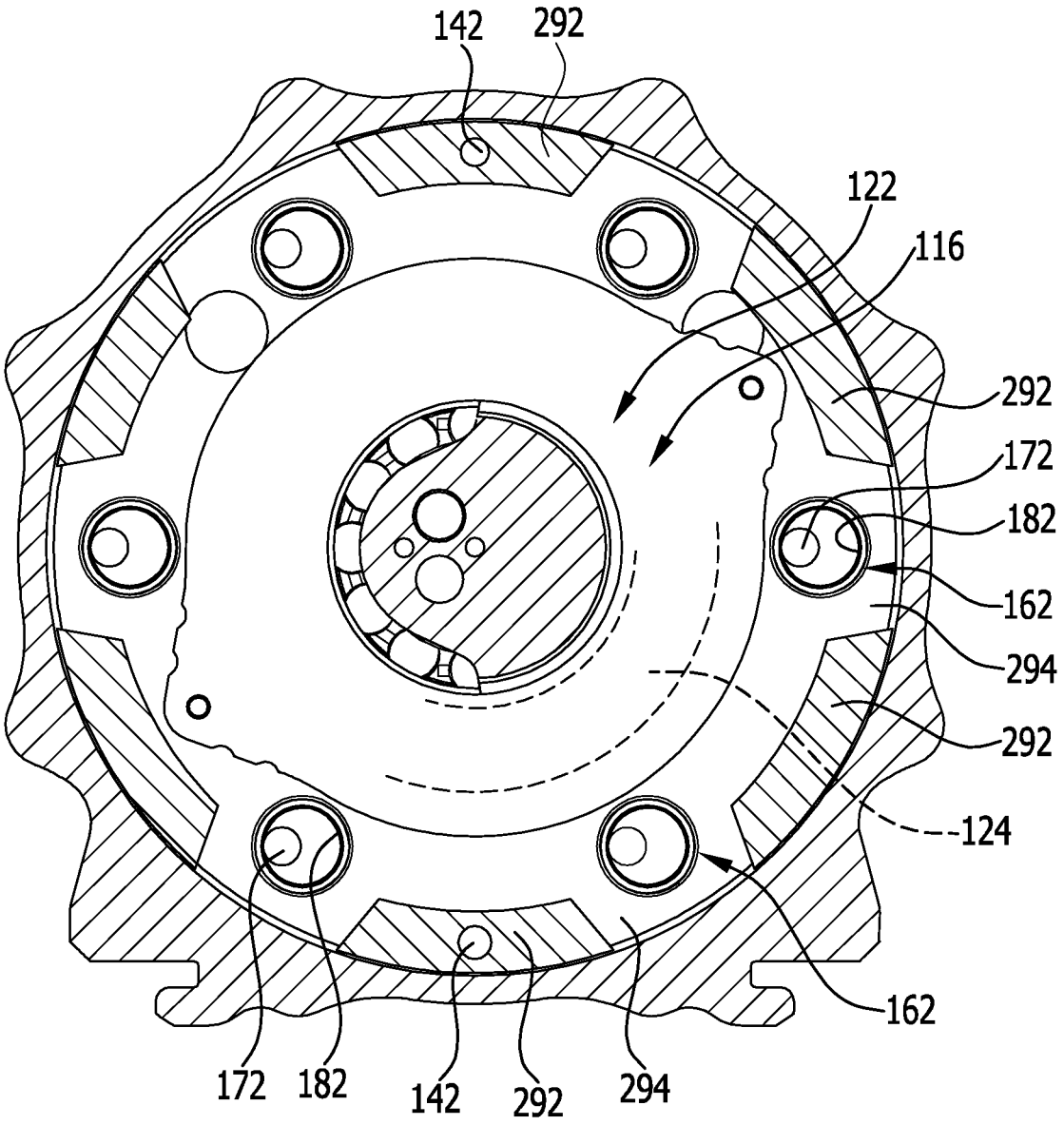
FIG. 11 shows a section along the line 11-11 in FIG. 9.

In a second exemplary embodiment, illustrated in FIGS. 9 to 11, the elements that are identical to those of the first exemplary embodiment are provided with the same reference numerals, so reference may be made to the statements made in respect of these elements in their entirety.

In contrast to the first exemplary embodiment, in the second exemplary embodiment the first, stationary compressor body 24' is not itself provided with the fingers 92, but rather its compressor body base 32' abuts radially within the annular portion 76' against the cover portion 74', and the annular projection 78' is provided with supporting fingers 292 that are supported against the carrier element 112 and are connected to the carrier element 112 in a manner that prevents them from rotating freely by the positioning pins 142, which in this case engage in the supporting fingers 292.

Otherwise, in this exemplary embodiment the compressor body base 36 takes the same form as in the first exemplary embodiment, and moreover the coupling element sets 162 also take the same form as in the first exemplary embodiment.

In particular, the extensions 212 are directed radially outward from the compressor body base 36, and in doing so engage in intermediate spaces 294 that lie between the supporting fingers 292, with the result that in this exemplary embodiment too it is possible for all the coupling element sets 162 of the coupling 164 that prevents free rotation of the second compressor body 26 to be arranged radially outward.

Figure 12:
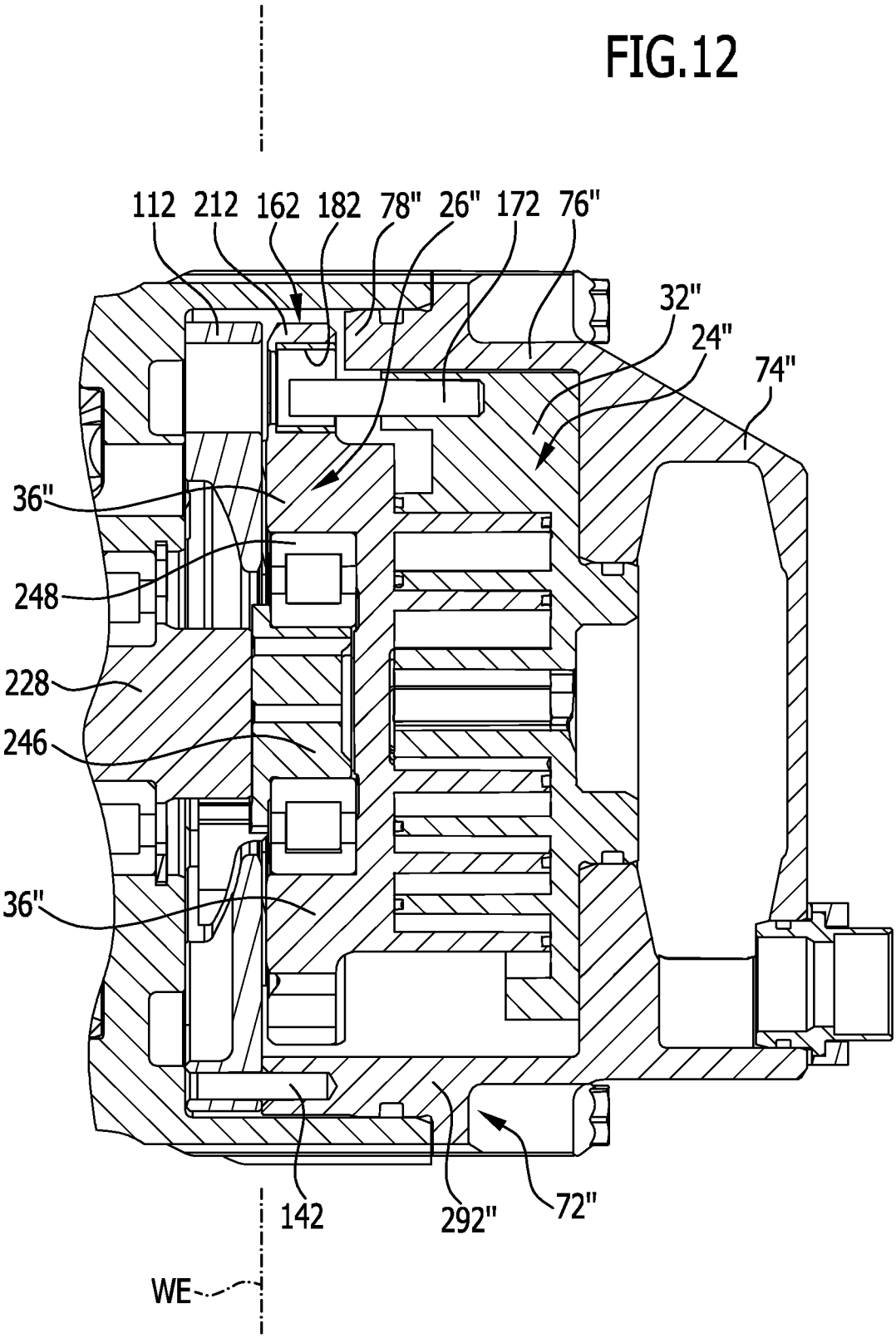
FIG. 12 shows a section similar to FIG. 9, through a third exemplary embodiment of a compressor according to the invention.

In a third exemplary embodiment, illustrated in FIG. 12, the elements that are identical to those of the exemplary embodiments above are likewise provided with the same reference numerals, so reference may be made to the statements made in respect of these exemplary embodiments.

In contrast to the exemplary embodiments above, in the third exemplary embodiment the extensions 212 of the compressor body base 36 of the second compressor body 26 take a form such that they receive the second coupling elements 182 of the coupling element sets 162, while the first coupling elements 172 of the coupling element sets 162 are held in the compressor body base 32" of the first compressor body 24 and extend into the second coupling elements 182. The advantage of this exemplary embodiment can be seen in the fact that, as a result, the coupling elements 172 and 182 cooperate in a plane of action WE that at the same time also passes through the pivot bearing 248 for the entrainer 246 and moreover also passes through the extensions 212 of the compressor body base 36".

Thus, the supporting action of the coupling element sets 162 of the coupling 164 is further improved, and in particular the tendency of the orbiting compressor body 26" to tilt in relation to the centre axis 44 is reduced.

Further, the third exemplary embodiment gives a broad degree of freedom, as regards the form and arrangement of the extensions 212 in the direction of the centre axis 44, in a manner different from the embodiment illustrated in FIG. 12, with the result that they may be arranged in optimised manner as regards their position in the direction of the centre axis 44, in relation to the axial support face 102 and the scroll vane 38 of the second compressor body 26.

The invention claimed is:

1. A compressor, including a compressor housing, a scroll compressor unit that is arranged in the compressor housing and has a first, stationary compressor body and a second compressor body that is movable in relation to the stationary compressor body, whereof first and second scroll vanes, in the shape of a circle involute, engage in one another to form compressor chambers when the second compressor body is moved in relation to the first compressor body on an orbital path running around a centre axis of the stationary compressor body, an axial guide that supports the movable compressor body to prevent movements in the direction parallel to the centre axis of the stationary compressor body and, in the event of movements, guides it in the direction transverse to the centre axis, parallel to a plane perpendicular to the centre axis, an eccentric drive for the scroll compressor unit, wherein the eccentric drive has an entrainer that is driven by a drive motor, that revolves on a path about the centre axis and that, for its part, cooperates rotatably with an entrainer receptacle in the second compressor body, and a coupling that prevents the second compressor body from rotating freely, the axial guide has a carrier element, which serves as a base for supporting a compressor body base, which carries the scroll vane, of the second compressor body against an axial support face, in that the axial support face is arranged radially outward of the entrainer, and the coupling that prevents free rotation has at least two coupling element sets that, for their part, include at least two coupling elements, and the coupling element sets are arranged radially outward of the axial support face.

2. The compressor according to claim 1, wherein the axial support face runs around the entrainer.

3. The compressor according to claim 1, wherein the axial support face is arranged radially outward of the entrainer receptacle.

4. The compressor according to claim 3, wherein the axial support face is arranged radially adjoining the entrainer receptacle.

5. The compressor according to claim 3, wherein the axial support face is arranged on a side of the entrainer receptacle that is remote from the scroll vane.

6. The compressor according to claim 1, wherein the axial support face includes an annular face region running peripherally around a centre axis of the second compressor body.

7. The compressor according to claim 6, wherein the annular face region takes the form of a face that runs continuously and in a closed manner around the centre axis of the second compressor body in a peripheral direction.

8. The compressor according to claim 6, wherein the annular face region extends from an internal contour to an external contour continuously and in a closed manner in the radial direction in relation to the centre axis of the second compressor body.

9. The compressor according to claim 8, wherein a radius of the internal contour is less than two thirds of a radius of the external contour of the annular face region.

10. The compressor according to claim 1, wherein an annular face region of the axial support face includes at least 80% of the total surface area of the axial support face.

11. The compressor according to claim 1, wherein an axial support face lies, slidably transversely to the centre axis, on a sliding body which for its part is supported, slidably transversely to the centre axis, on the carrier element that is arranged in the compressor housing.

12. The compressor according to claim 11, wherein the sliding body is movable in two dimensions, in relation to the compressor body base of the second compressor body and in relation to the carrier element.

13. The compressor according to claim 11, wherein the sliding body is guided in a two-dimensional guidance with play such that it is movable in relation to the compressor body base of the second compressor body and/or in relation to the carrier element.

14. The compressor according to claim 1, wherein the axial support face is supported on an annular face of a sliding body that runs peripherally around the centre axis of the first compressor body.

15. The compressor according to claim 14, wherein the annular face of the sliding body takes the form of an annular face that runs continuously and in a closed manner around the centre axis of the first compressor body in a peripheral direction.

16. The compressor according to claim 1, wherein the axial support face is adjoined, radially inwardly or outwardly, by an edge face of the second compressor body base that is set back in relation to a plane in which the axial support face extends.

17. The compressor according to claim 1, wherein a sliding body is supported against the carrier element by a sliding bearing face.

18. The compressor according to claim 17, wherein the carrier element has a carrier face against which a sliding body is supported by the sliding bearing face.

19. The compressor according to claim 1, wherein a sliding body takes a plate-like form, in particular as an annular disc.

20. The compressor according to claim 1, wherein the second compressor body is provided with extensions that extend radially outward of a centre axis of the second compressor body and on each of which a coupling element of the coupling element sets is held.

21. The compressor according to claim 20, wherein the extensions are held on the compressor body base of the second compressor body.

22. The compressor according to claim 20, wherein the extensions are integrally formed in one piece with the compressor body base.

23. The compressor according to claim 20, wherein the extensions engage in intermediate spaces arranged around the second compressor body on the housing side.

24. The compressor according to claim 1, wherein the axial support face is formed by the compressor body base, which carries the scroll vane, of the second compressor body itself, and in that the axial guide supports the second compressor body against this axial support face, slidably transversely to the centre axis of the stationary compressor body.

25. The compressor according to claim 1, wherein the entrainer receptacle is integrated in the compressor body base.

26. The compressor according to claim 25, wherein the entrainer receptacle is arranged on the compressor body base such that it does not project beyond the support face in the direction parallel to the centre axis of the stationary compressor body.

27. The compressor according to claim 1, wherein the coupling that prevents free rotation has more than two coupling element sets.

28. The compressor according to claim 27, wherein the coupling element sets are arranged at equal angular spacings around the centre axis of the stationary compressor body.

29. The compressor according to claim 27, wherein one of the coupling elements of the respective coupling element set is held on the compressor body base of the second compressor body.

30. The compressor according to claim 27, wherein one of the coupling elements is held on the carrier element.

31. The compressor according to claim 27, wherein one of the coupling elements of the respective coupling element set is formed by a pin body.

32. The compressor according to claim 27, wherein the other of the coupling elements of the respective coupling element set takes the form of a cylindrical receptacle.

33. The compressor according to claim 27, wherein one of the coupling elements of the respective coupling element set takes the form of an annular body arranged in the cylindrical receptacle.

34. The compressor according to claim 33, wherein the annular body is seated in the cylindrical receptacle loosely.

35. The compressor according to claim 1, wherein the centre axis of the stationary compressor body extends level.

36. The compressor according to claim 1, wherein a drive shaft of the drive motor extends level.

37. A compressor, including:

a compressor housing, a scroll compressor unit that is arranged in the compressor housing and has a first, stationary compressor body and a second compressor body that is movable in relation to the stationary compressor body, whereof first and second scroll vanes, in the shape of a circle involute, engage in one another to form compressor chambers when the second compressor body is moved in relation to the stationary compressor body on an orbital path running around a centre axis of the stationary compressor body, an axial guide that supports the movable compressor body to prevent movements in the direction parallel to the centre axis of the stationary compressor body and, in the event of movements, guides it in the direction transverse to the centre axis of the stationary compressor body, parallel to a plane perpendicular to the centre axis of the stationary compressor body, an eccentric drive for the scroll compressor unit, wherein the eccentric drive has an entrainer that is driven by a drive motor, that revolves on a path about the centre axis of the stationary compressor body and that, for its part, cooperates rotatably with an entrainer receptacle in the second compressor body, and a coupling that prevents the second compressor body from rotating freely, the axial guide has a carrier element, which serves as a base for supporting a compressor body base, which carries the scroll vane, of the second compressor body against an axial support face, in that the axial support face is arranged radially outward of the entrainer, and the coupling that prevents free rotation has at least two coupling element sets that, for their part, include at least two coupling elements, and the coupling element sets are arranged radially outward of the axial support face, wherein the stationary compressor body is positioned in the direction of its centre axis, and in particular at the same time is supported by supporting fingers that are supported against the carrier element.

38. The compressor according to claim 37, wherein intermediate spaces lie between the supporting fingers that carry the stationary compressor body.

39. The compressor according to claim 38, wherein the stationary compressor body is fixed by the supporting fingers such that it cannot rotate freely in relation to the carrier element, to prevent rotation about its centre axis.

* * * * *